United States Patent [19]

Daub

[11] 4,236,384

[45] Dec. 2, 1980

[54] LOCKING ASSEMBLY FOR ARTICLE OF JEWELRY

[76] Inventor: Arthur R. Daub, 59 Burns Ave., Hicksville, N.Y. 11801

[21] Appl. No.: 939,128

[22] Filed: Sep. 1, 1978

[51] Int. Cl.[3] ..... A44C 5/00

[52] U.S. Cl. ..... 63/7

[58] Field of Search ..... 63/3, 4, 6, 7, 8, 11, 63/15.7

[56] References Cited

U.S. PATENT DOCUMENTS

| | | | |
|---|---|---|---|
| 128,447 | 6/1872 | Yeiser | 63/7 |
| 143,382 | 9/1873 | Ranger et al. | 63/7 X |
| 228,723 | 6/1880 | Barbier et al. | 63/7 |
| 229,360 | 6/1880 | Bishop | 63/7 |
| 888,057 | 5/1908 | Barney | 63/4 |
| 3,566,616 | 3/1971 | Benedict | 63/15.7 |

*Primary Examiner*—F. Barry Shay

*Attorney, Agent, or Firm*—Haseltine, Lake & Waters

[57] ABSTRACT

An article, such as a ring structure for example, having a band and an ornamental portion affixed on the top thereof. The band is formed of two portions each being pivotally hinged with respect to one another. One end of the portion of the band is provided with a wedge shaped resilient locking member which cooperates with a lock formed in a space formed between an upper surface of the band and the ornamental portion of the ring. For opening the ring from the closed to the open position, the user inserts a key in a keyway formed in the hollow space, whereby the key causes the locking member to be released from the lock and in turn as a rotational force applied the key upon the locking member, the band portion will be caused to pivot about the pivot point thus opening the ring band permitting release from the finger. Alternate embodiments include a locking arrangement without the hinge assembly.

6 Claims, 10 Drawing Figures

FIG. 1
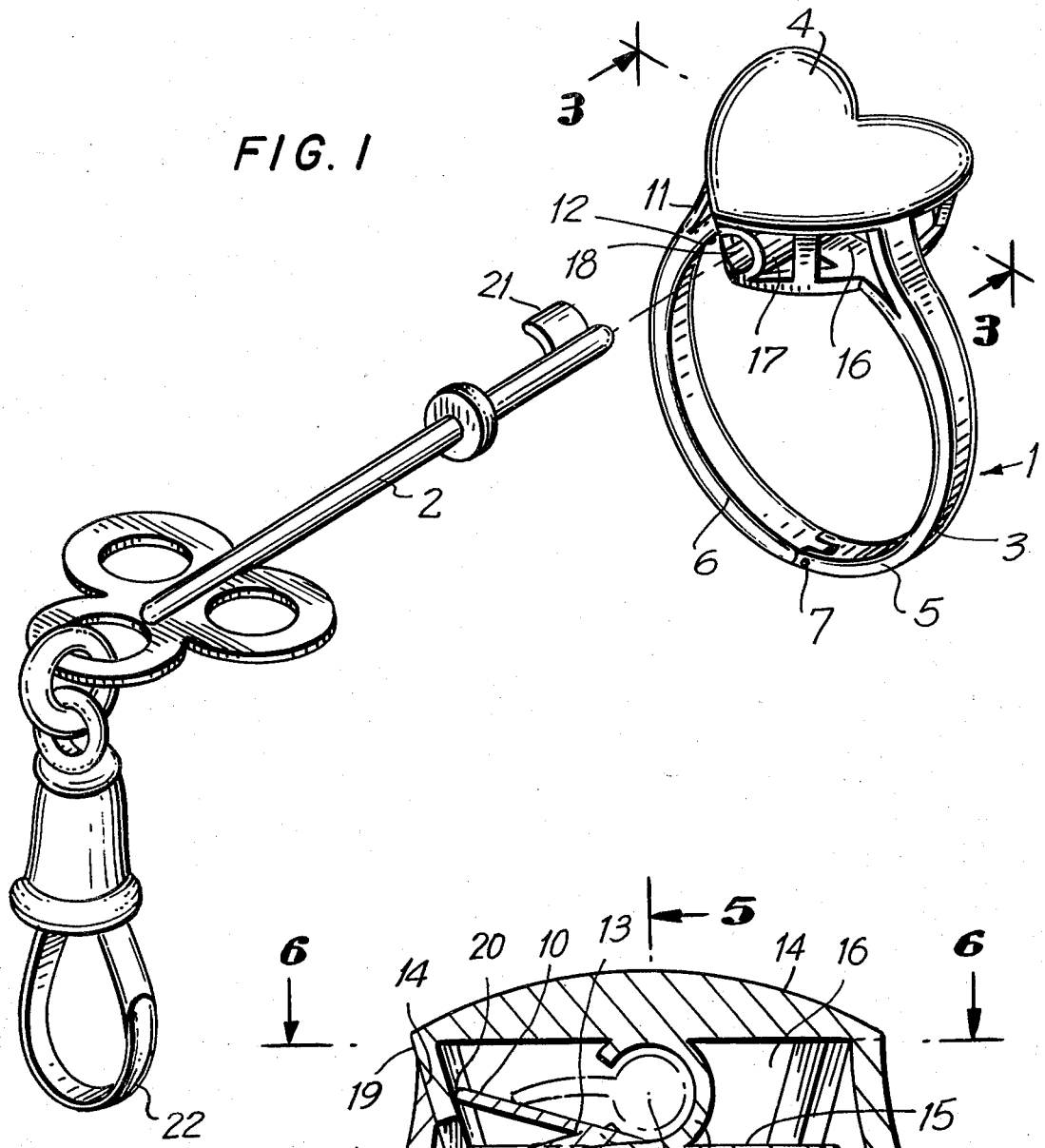
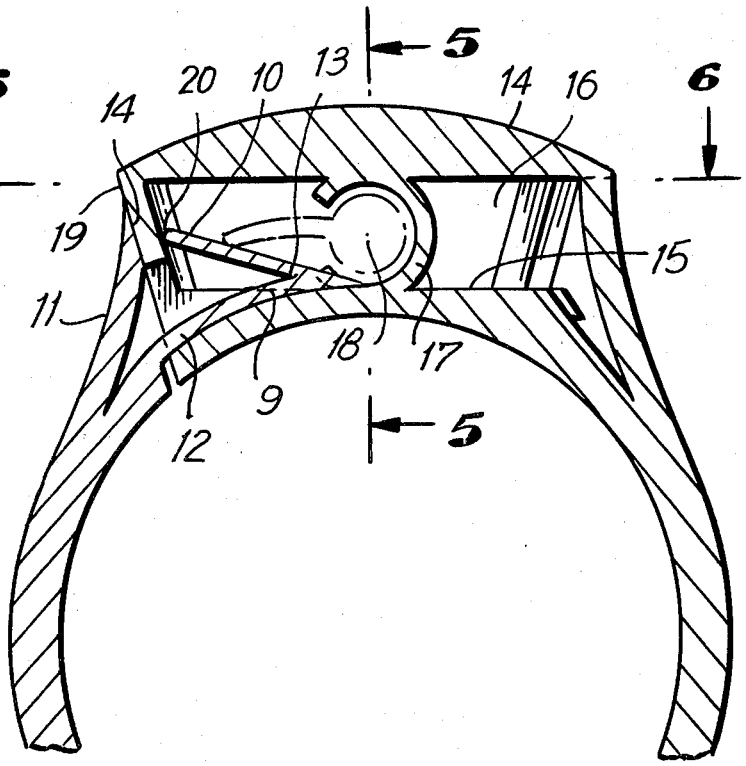
FIG. 3

LOCKING ASSEMBLY FOR ARTICLE OF JEWELRY

BACKGROUND OF THE INVENTION (a) Field of the Invention

The present invention is principally directed to a ring assembly for use on a finger, such as for ornamental purposes. Also within the scope of the invention is the use of the invention with other articles of jewelry such as braclets, chokers, etc. This will be discussed in detail hereinafter.

More particularly, the present invention is directed to a ring assembly which is formed to permit easy placement and removal from a user's finger particularly where the user may have certain irregularities in the contouring of his finger which would normally create an uncomfortable condition for so doing.

An alternate embodiment contemplates articles which employ the inventive lock with or without additional structure defined in the preferred embodiment.

The ring assembly of the present invention has been formulated with a view toward permitting ease of placement and removal, especially, off of the finger of a user who may have abnormally enlarged knuckles or other portions of the finger, such as due to illness, i.e. arthritis. The irregularity in the contouring of the finger normally makes the placement and withdrawal of the ring from the finger a most unpleasant situation. Up until the present invention, the employment of various structures to a ring configuration enabling withdrawal and placement on the finger have been most complicated and certainly not lending themselves to use in ring assemblies where the ring is to have a pleasant appearance.

(b) Prior Art

While the use of hinged bands of different types have been known in the prior art, such as in U.S. Pat. No. 1,128,084 and 3,566,616, these particular configurations represent art which have band locking arrangements completely different from that of the present invention. In the use of a ring of the type to which the present invention is drawn, the importance associated with the locking arrangement, that is, the locking of an open end of the ring band whereby the actual use of a lock is not visible to the outside world, is something that has not been satisfactorily treated in the prior art, as for example, in the aforementioned references. In other words, while the concept of opening a ring to enable an individual with enlarged knuckles, caused by some condition, has been attended to in some fashion, nonetheless a locking configuration which is not visible and which aids in the over all appearance of the ring has not been contemplated at all in the prior art.

The band locking arrangements in the prior art are bulky, somewhat uncomfortable, and not within the contemplation of the present invention.

SUMMARY OF INVENTION

It is the main object of the present invention to overcome the defects of the prior art.

It is a further object of the present invention to provide a ring assembly whereby the user is able to place and withdraw the ring from a finger without any uncomfortable feeling in the event such user has an abnormality in the finger itself.

Another object of the present invention is to provide simply constructed ring assembly whereby the locking of the ring takes place in a simple manner and locking and unlocking is effected by a separate key cooperating with the ring assembly.

Still another object of the present invention is to provide a locking assembly for use with items such as braclets, chokers, and ear rings.

A further object of the present invention is to provide a ring assembly having universal applicability to rings of different sizes and shapes.

The principal features of the present invention are directed to a ring assembly for use on user's finger employing a band portion having an open and closed position, an associated ornamental portion disposed above said band portion, said band portion being formed of first and second arcuate portions each being hingedly connected to one another at first ends thereof; means affixed at a second end of said first arcuate portion for engaging locking means when said second end is advanced to said closed portion; said locking means being disposed within an interior space formed between said ornamental portion and a top section of said band portion; and key means adapted to fit into said interior space to cause release of said means affixed at said second end of said first arcuate portion from said locking means, to thereby enable said ring to assume an open portion by rotational movement of said hingedly connected first arcuate portion.

Also within the scope of the present invention is means affixed to said first arcuate portion comprising a leaf spring member biased to an open condition, said end portion of said first arcuate portion being in turn formed of a generally Y shaped working portion, a first leg of said Y shaped working portion being offset with respect to the remainder of the arcuate portion and having said leaf spring mounted at the terminus thereof, the second leg of the Y-shaped portion being shorter than said first leg and having its terminus disposed to engage means forming a side surface surrounding said interior space.

Other objects, features and advantages of the present invention will be readily ascertainable with respect to the accompanying specification, claims and drawings.

IN THE DRAWINGS

FIG. 1 is an exploded perspective view of the invention illustrating the key and ring in the closed position.

FIG. 3 is a partial section along line 3—3 in FIG. 1.

PREFERRED EMBODIMENT OF THE INVENTION

Figure 2:
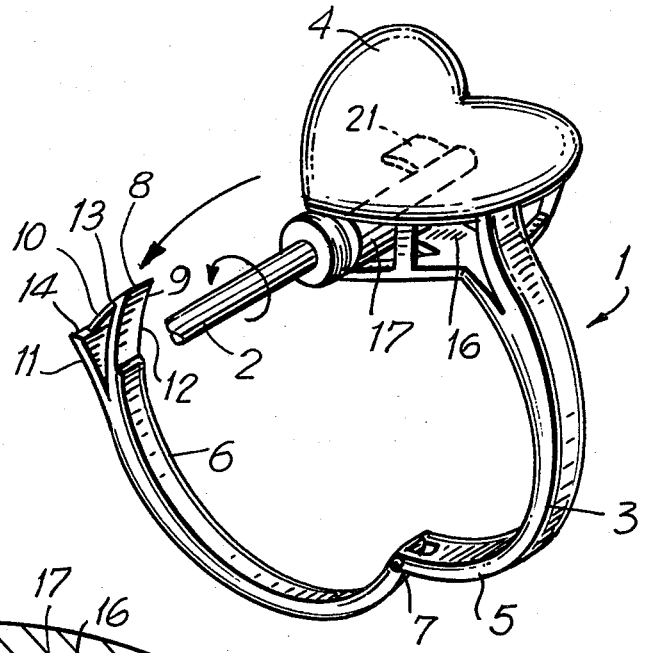
FIG. 2 is a view similar to FIG. 1 illustrating the ring in the open position with key inserted therein.

As is illustrated in FIG. 1, a ring assembly includes a ring 1 and a key 2 which is adapted to cooperate with the ring in a fashion described hereinafter. The ring basically is formed of a band 3 and an associated ornamental portion 4 disposed above the band. In turn the band is formed of two portions comprising a first portion 5 and a second portion 6. Th band portions coact with respect to one another about a hinged pivot point 7 formed in a conventional fashion with a pin disposed at such pivot point 7.

As can be seen from FIG. 2, the key 2, when inserted into the upper portion of the ring 1 and rotated, causes one end of the second band portion 6 to be detached from the ring 1. The exact manner in which this occurs will be set forth in more detail hereinafter. The second band portion 6 has associated at its working end 8 a wedge shaped locking member 9 which is more clearly illustrated in FIGS. 3 and 4. It will be noted that the working end 8 of the second band portion 6 is of generally Y shape with two legs 11 and 12 associated therewith. The second leg 12 extends for a greater length and is joined with a resilient upper portion 10 at edge 13. The first leg 11 is somewhat shorter than leg 12 and is provided with an abutting surface 14 at the terminus thereof. A hollow space 16 is defined by the ornamental portion 4 and an upper surface 15 spaced therefrom which is a continuation of the band 3. The hollow space 16 has disposed therein a generally cylindrical member 17 affixed therein and forming a keyway 18. As can be seen from FIGS. 3 and 4, the cylindrical member is generally C shaped in form. The portion of the ring in which the ornamental portion is formed is provided, at the areas where the band joins such portion, with a peripheral surface portion 19 which forms a surface with which the band merges and cooperates with and also aids in the locking arrangment as between the working end of the second end portion 6. More particularly, an abutment 19 is formed and serves to cooperate with the terminus and abutment in the leg 12 as well as the end portion of the resilient upper portion 10. In this regard, an opening sufficient to permit the resilient upper portion to enter into the hollow space 16 exists at the side of the ring 1, whereby the end portion of the abutment 19 serves to depress the resilient upper portion 12 as it is advanced into the hollow space 16. Continuous movement of the second band portion into the hollow space causes engagement of the terminus of leg 11 and the abutment 19 and at the same time the wedge-shaped locking member 9 engages the cylindrical member 17 and the end 20 of resilient upper portion 10 contacts the inner surface on abutment 19 opposite to that engaged by the terminus 11. The resilient upper portion 10 is affixed to the leg 12 and forms a generally wedged shaped structure whereby urging of the wedge through the space formed by the abutment 19 and the lower surface 15 of the band 3 permits the abutment to urge the resilient member downwardly and enable advancement into engagement with abutment 19 as well as the cylindrical member 17. Forward advance of the resilient upper portion with respect to the cylindrical member 17 is governed by the relationship of the abutment 19 with respect to the terminus of leg 11. Once this occurs, locking takes place whereby the ring is in a fixed position insofar that the band is fastened and connected to the ornamental portion of the ring 4.

Figure 6:
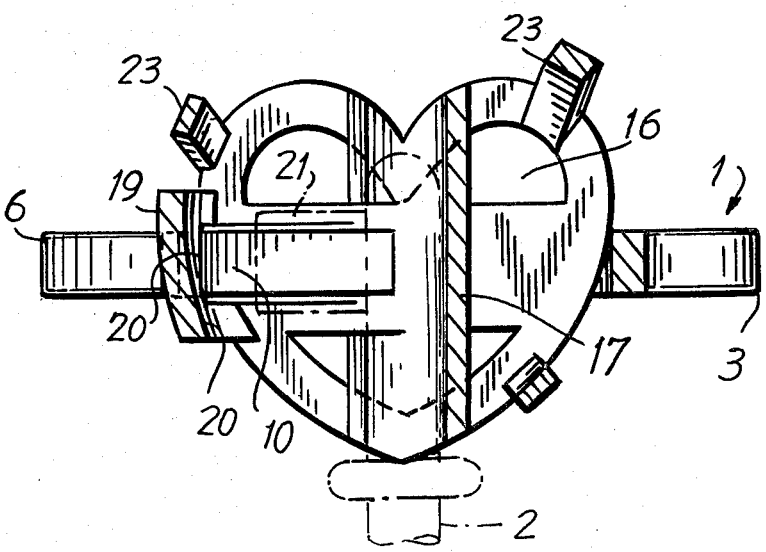
FIG. 6 is a sectional view taken along line 6—6 in FIG. 3.
Figure 5:
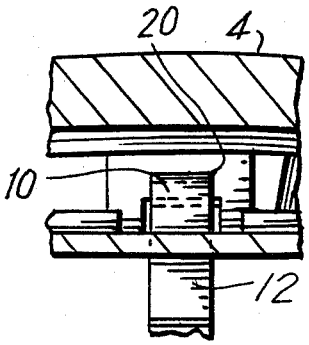
FIG. 5 is a partial section view taken along line 5—5 in FIG. 3.

As can be seen clearly from FIGS. 3 and 6, once locking has taken place by way of the resilient upper portion acting upon the abutment 19 and the cylindrical member 17, the second band portion 6 meets the ornamental portion 4 in such a manner that the locking arrangement is not visibly seen from the outside as the ring is worn. Obviously, the pivot point 7 is at the lower portion of the ring assembly and the locking arrangement is hidden by virtue of the interrelationship of the second band portion 6 as described above, to enable the appearance of the ring to be viewed in a manner which is pleasant in appearance without affecting the aesthetics or styling of the ring whatsoever.

Figure 4:
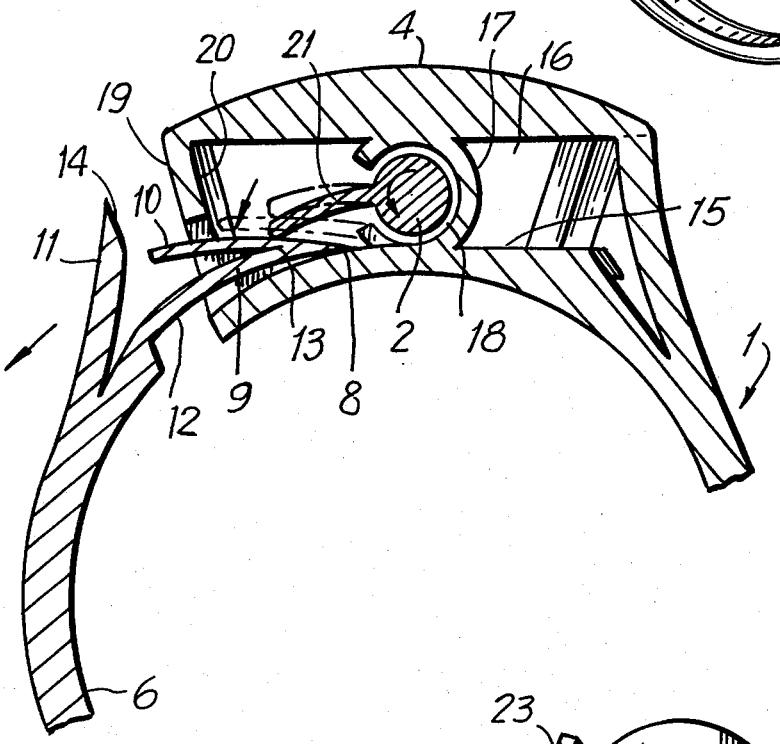
FIG. 4 is a view similar to FIG. 3 illustrating the locking arrangement of the invention.

The key 2 is insertable into the keyway 18 and, if rotated in a fashion as shown in FIGS. 2 and 4, the downward force applied to the resilient upper portion 10 causes it to move downward and to disengage from the abutment 19 and the cylindrical member 17. Simultaneously, with this downward rotational force exerted through the key 2, the second band portion 6 can be moved out of the hollow space 16 allowing the second band portion 6 to be pivoted about the hinge pivot point 7 to permit the ring to open and the user to remove the same from the finger.

Once the second band portion 6 is pivoted, the key may be removed from the keyway 18 and placed aside. The key itself is of an conventional design which has a extending member 21 which is of a sufficient contour and length to act upon the resilient upper portion 10 to enable it to be disengaged from the abutment 19 enabling the removal of the second band portion from the hollow space 16. The key is also provided with a ring 22 which can be worn by the user or anyone whom such user might designate. For example, one may employ the present invention in the form of a love ring whereby a friend of the user may have the key to remove the ring from the user at will, to be replaced at some future date and under an appropriate occasion.

The fashion in which the hollow space 16 is formed can be varied depending upon the style of the ring, however, as shown in FIG. 6, supporting members 23 are employed as between the lower surface of the ornamental portion 4 and the upper surface 15 of the band 3. Of course, the style and space requirements can be varied without affecting the spirit and scope of the present invention. It is suggested that the present invention has universal applicability and is quite readily assembled and the locking arrangement is of a straightforward construction to minimize cost and permit ease of operation.

ALTERNATE EMBODIMENT

Figure 7:
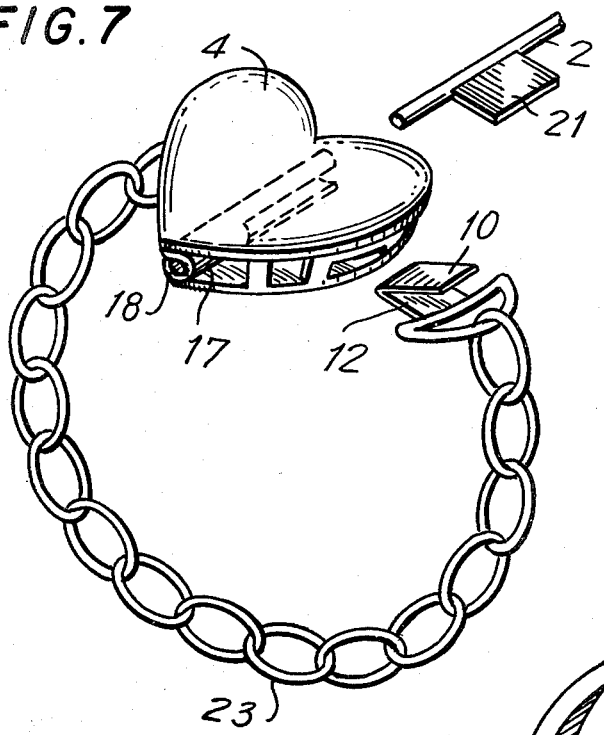
FIG. 7 illustrates the use of the invention for a braclet having links.
Figure 8:
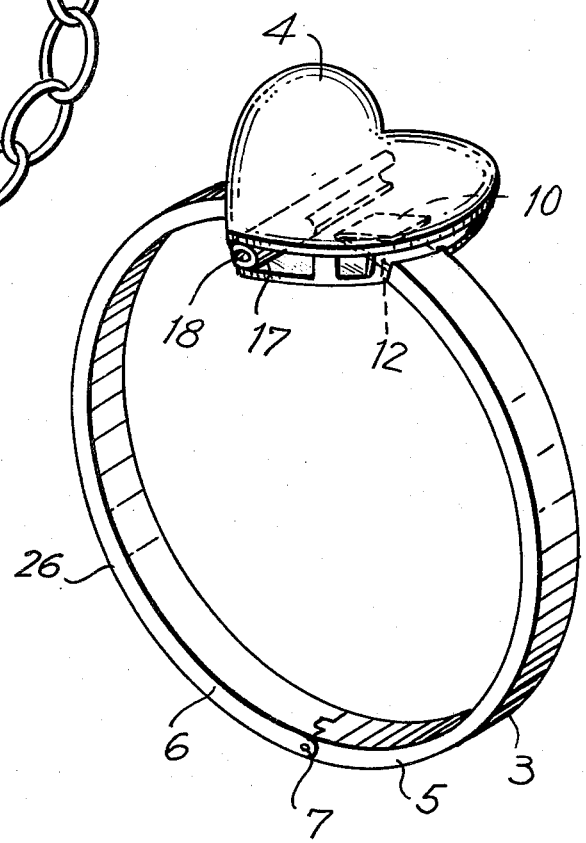
FIG. 8 illustrates the use of the invention with a bangle braclet.
Figure 9:
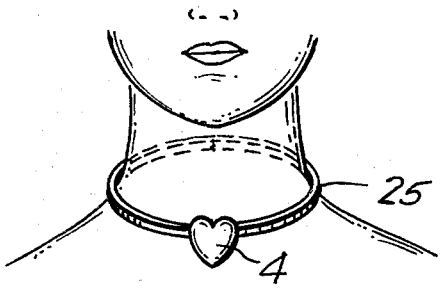
FIG. 9 illustrates the use of the invention with a choker.
Figure 10:
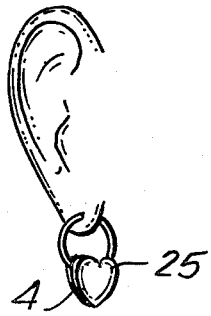
FIG. 10 illustrates the use of the invention with an ear ring.

Also within the scope of the present invention is the use of a locking arrangement similar to that as set forth for the ring assembly described hereinabove and shown in FIGS. 1–6. As contemplated and shown in FIGS. 7–10, other types of articles to which the locking arrangement can apply are loose braclets 28 (FIG. 7); chokers 24 (FIG. 9); ear rings 25 (FIG. 10). With regard to braclets 26 of the type shown in FIG. 8 the hinge assembly with two arcuate portions of the type hereinbefore discussed, would be necessary in order to assist in the removal of such braclet from the users wrist. It is intended where applicable that all numerals refer to similar elements of the structure as set forth hereinabove with respect to FIGS. 1–6.

Many modifications and variations of the present invention are possible in light of the above teachings. It is, therefore, to be understood that within the scope of the appended claims, the invention may be practiced otherwise than as particularly described.

What is claimed is:

1. An assembly for use as an article of jewelry having an associated ornamental portion affixed to said article, said article comprising first and second arcuate portions hingedly connected to one another at first ends thereof; means affixed at a second end of said first arcuate portion for engaging locking means on said second arcuate portion when said second end is advanced to a closed position with respect to said second arcuate portion; said locking means being disposed within an interior space formed between said ornamental portion and a top section of said second arcuate portion; key means adapted to fit into said interior space to cause release of said means affixed at said second end of said first arcuate portion from said locking means, thereby to enable said article to assume an open position by pivotal movement of said hingedly connected first arcuate portion, said means affixed to said first arcuate portion comprising a leaf spring member, said second end portion of said first arcuate portion including a generally Y shaped working portion comprising a first leg having said leaf spring member mounted at the terminus thereof, said leaf spring member having a normal position with its free end biased away from said first leg, and a second leg having a terminus, and abutment means extending below said ornamental means and being partially disposed across an entrance portion of said interior space, said abutment means having an inner surface adapted to engage said free end of said leaf spring member after said leaf spring member enters said interior space, and an outer surface against which said terminus of said second leg abuts to complete locking of said first arcuate portion to said ornamental portion.

2. An assembly as claimed in claim 1, comprising keyway means within said interior space and defined by a generally circular shaped member having an opening for receiving and engaging a portion of said first leg as locking takes place within said interior space.

3. An assembly as claimed in claim 2 wherein: said key means comprises locking release means for engaging said leaf spring member after insertion of said key means into said keyway means, whereby rotational movement of said key means sufficient to overcome bias of said leaf spring member, urges said leaf spring member to move toward said first leg causing disengagement of said leaf spring member with respect to said abutment means and simultaneous pivotal movement of said first arcuate portion about its hinge connection permits said article to open.

4. An assembly as claimed in claim 1, wherein said interior space is formed by a hollow area below said ornamental portion and above an upper surface of said second arcuate portion, said interior space having an integrally formed C shaped keyway.

5. An assembly as claimed in claim 1, wherein said article of jewelry is a ring.

6. An assembly as claimed in claim 1 wherein said second leg is shorter than said first leg.

* * * * *